United States Patent [19]

Kirk, Jr.

[11] 4,000,594

[45] Jan. 4, 1977

[54] BUILDING CONSTRUCTION MEMBER

[76] Inventor: James D. Kirk, Jr., 40 N. Tower Road, Apt. 14L, Oak Brook, Ill. 60521

[22] Filed: Jan. 13, 1975

[21] Appl. No.: 540,420

[52] U.S. Cl. ..... 52/241; 52/71; 52/619; 52/745

[51] Int. Cl.[2] ..... E04B 2/00

[58] Field of Search ..... 52/241, 71, 619, 481, 52/493, 745, 416, 405, 746

[56] References Cited

UNITED STATES PATENTS

| | | | |
|---|---|---|---|
| 2,557,412 | 6/1951 | Clements | 52/619 |
| 2,867,857 | 1/1959 | McCarthy | 52/619 X |
| 3,564,785 | 2/1971 | Kephart | 52/71 |
| 3,731,449 | 5/1973 | Kephart | 52/71 |

FOREIGN PATENTS OR APPLICATIONS

| | | | |
|---|---|---|---|
| 776,982 | 11/1934 | France | 52/22 |

*Primary Examiner*—J. Karl Bell
*Attorney, Agent, or Firm*—Thomas W. Speckman

[57] ABSTRACT

A building construction member comprising a rectangular panel with perpendicular flanges extending from one face thereof along opposed edges to form a shallow channel-shaped construction module. When the member is arranged side-by-side with other like members, the abutted flanges of adjacent members become the studs of a wall or the joists of a ceiling. When used to build a wall finished on both sides, the studs of the two sides are interspersed, and may be placed in contact with the panels of the opposite side to reinforce the panels.

Also disclosed is the blank from which the construction member is fabricated, with particular detail of the gypsum board blank for interior surfaces.

16 Claims, 12 Drawing Figures

FIG.4
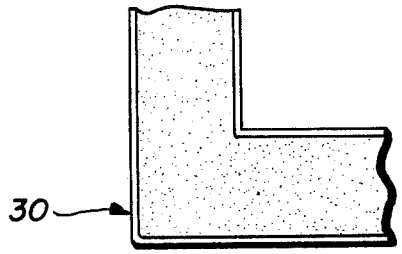
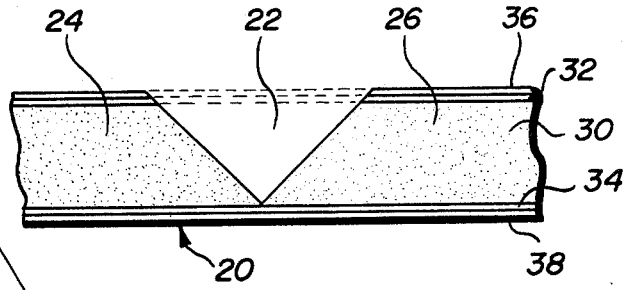
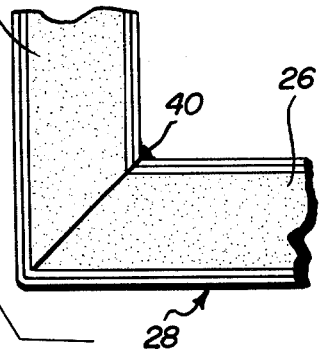
FIG.5
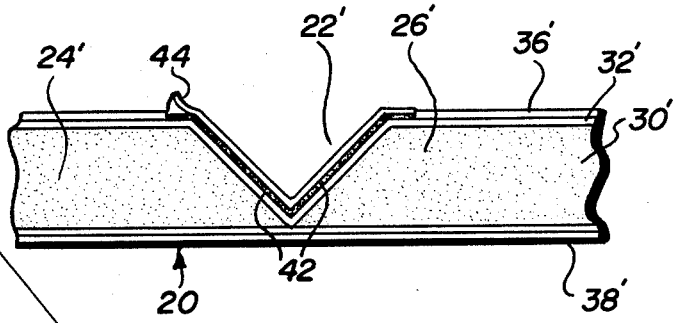
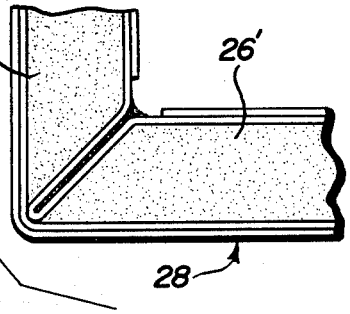
FIG.6
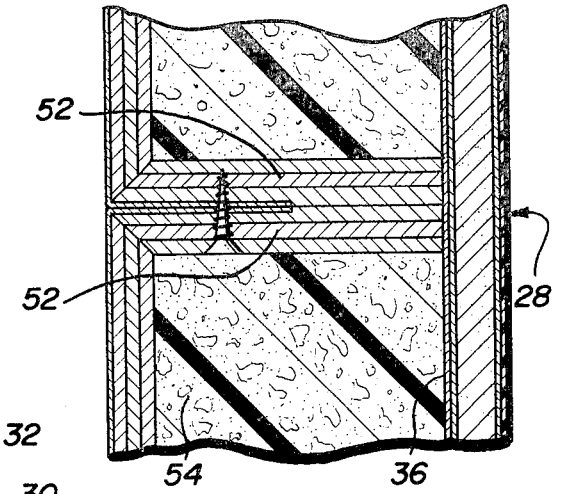
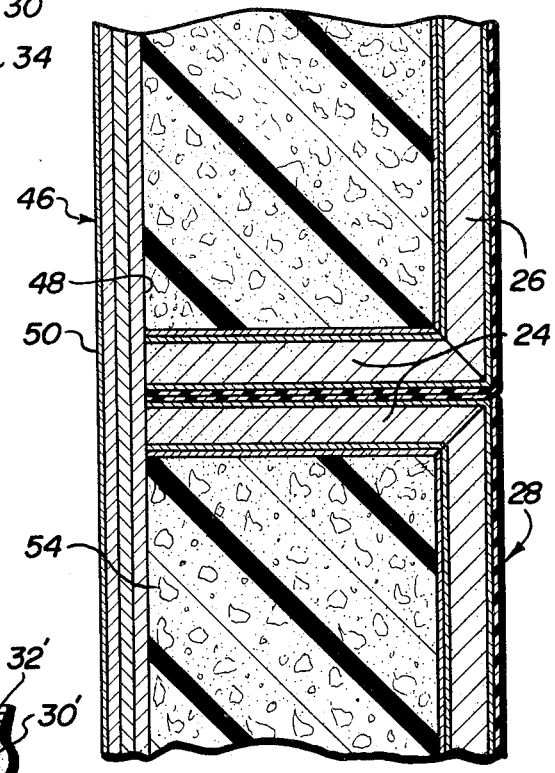
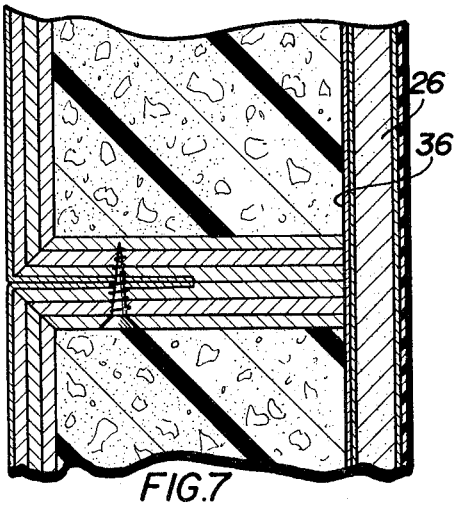
FIG.7

BUILDING CONSTRUCTION MEMBER

This invention relates to building construction and in particular to a building construction member which is especially adapted for the construction of walls and ceilings.

BACKGROUND

In much of current construction of buildings for industrial and commercial purposes, so-called "dry wall" construction is widely used for interior non-loadbearing partitions. Current practice is to erect such walls by attaching gypsum board to a framework of sheet metal studs and other framing members to both sides of which gypsum board is attached by means of sheet-metal screws. The spacing of the metal studs in such framework is governed by the dimension of the covering wall panels which are conventionally 4 feet wide, and require the placement of metal studs on not more than 24 inches centers for minimum support of the gypsum board panel midway between the vertical joints between adjacent boards. Local code requirements may reduce stud spacing to 16 inches, i.e., requiring three studs per 4-foot panel instead of two.

The attachment of the gypsum board to the sheet-metal framing is done with power driven self-drilling, self-tapping screws, and the finishing of the vertical joints is done by decorators who tape and fill the joints with spackling plaster and repair any dimples in the gypsum board occasioned by the driving of the attaching screws.

The process requires a substantial amount of manual labor in the erection of the wall framing, in the attachment of the gypsum board panels, and in the necessary touchup required of the decorators in the patching of the joint and any tool marks made in the panel during the erection process.

Moreover, such partition walls, while satisfactory for their purpose, suffer from being relatively immovable due to the permanence of the attachment of the gypsum board to the metal framing, which renders the gypsum board panels largely unsalvagable in the event that later movement of the wall is required.

The construction member and erection technique of this invention greatly simplify the erection of interior partition walls of the dry wall type, render such walls movable and reusable in new locations, and materially reduce the erection time and the labor required, thus reducing the cost of such walls, as well as adapting them for reuse as space requirements may vary.

The construction member of the invention modified dimensionally from that contemplated for interior partition walls, is adaptable as well for use as a ceiling member. Also, by the judicious selection of component materials, it is adaptable as well for constructing exterior walls not only of the non-loadbearing type employed to sheath building structures of the structural skeleton type, but also for exterior walls of a loadbearing kind which carry relatively light loads, as, for example, in residental construction.

A basic characteristic of the construction member, whether the component materials are such as to adapt it for interior or exterior use, is that when used as a wall member, it provides its own studs, and when used as a ceiling member, provides its own joists.

THE DRAWINGS

The invention will be understood from the following description taken in conjunction with the accompanying drawings(three sheets) in which:

FIG. 4 is a fragmentary cross-sectional view of a construction member such as is illustrated in the lower half of FIG. 1, but with the flange formed integrally with the panel portion of the construction member in the gypsum-casting process;

FIG. 5 is a two-part fragmentary sectional view of a folded corner at the joint between flange and panel of the construction member of FIG. 1, utilizing one form of adhesive bond at the corner joint, whereas, FIG. 6 is a similar two-part fragmentary sectional view of a modified corner joint which is particularly suited for field erection of the self-studding flange;

FIg. 7 is a horizontal cross-sectional view of an exterior wall employing the assembly technique of FIG. 2, but in which the component materials of the exterior panels, and those as well of the interior panels, are especially chosen for exterior wall application;

GENERAL SUMMARY OF THE INVENTION

Figures 1, 2, 3:
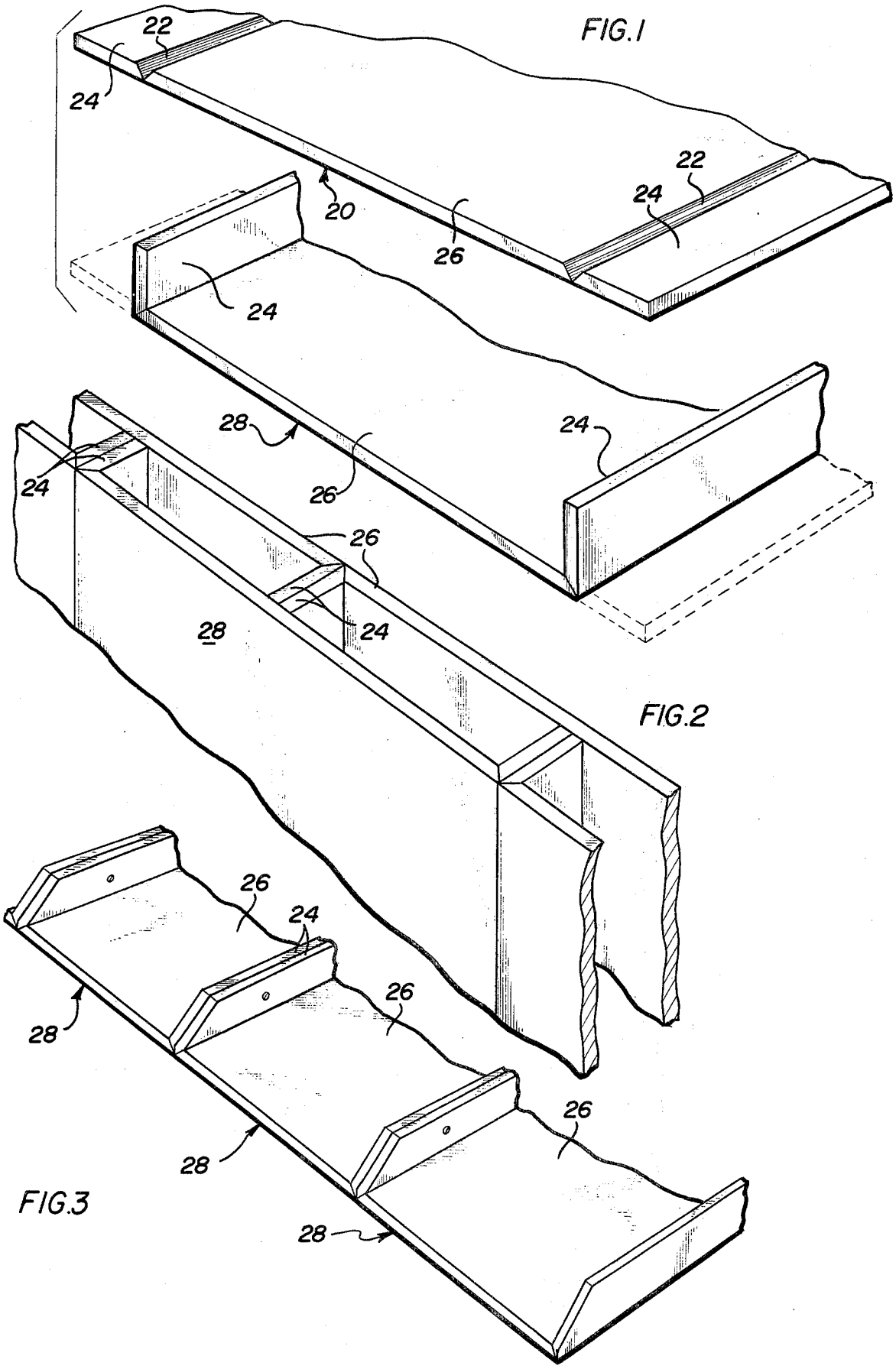
FIG. 1 is a two-part isometric view of the construction member of the invention showing the member first in its flat "blank" form, notched for the folding up of its flanges, and secondly in the flanged or folded form, ready for erection.
FIG. 2 is a fragmentary isometric view of a wall made by assembling a plurality of the construction members of FIG. 1 back-to-back, and side-by-side, with the juxtaposed flanges of adjacent construction members on one side of the wall interspersed with those of the other for the mutual support of each construction member at the mid-point of its panel.
FIG. 3 is a fragmentary assembly of the construction members of FIG. 1 modified somewhat in dimension, and slightly in the end treatment of the flanges, to facilitate their use as ceiling panels.

The construction member of the invention is essentially a panel having perpendicular flanges along a pair of opposed parallel edges, usually the longer edges of the panel. When ready for installation, the member is thus a wide, shallow channel, which may be assembled with other like or similar panels to form the walls or ceiling of a building structure.

In such assembly, whether as a wall or a ceiling, adjacent construction members are butted against each other so that their juxtaposed flanges serve as studs, in the case of a wall assembly, or as joists, in the case of a ceiling.

In the wall arrangement, the studs so formed by the flanges of the construction members on one side of the wall are interspersed medially of those formed by the construction members of the opposite side of the wall so that the panel portion of each construction member is supported at its midpoint, or as near thereto as may be feasible, as well as at its end.

For interior partition wall construction, the construction members may be of gypsum board, which is available readily in panels 4 feet wide. In conventional dry wall construction, normal interior spacing of the panels between opposite sides of a wall is either 2½ inches or 3⅝ inches. Thus, taking gypsum board in standard width as the basic component for interior construction, and grooving the panels from one side to fold up a mitered flange using the intact opposite face lamina as a hinge, the width of each construction member for wall erection purposes would be approximately 42 inches, or less, depending upon the thickness of the board, and the desired thickness of the finished wall. The overall width of the construction member, when used to build a wall following the assembly pattern indicated by FIG. 2, also becomes the center line distance of the "studs" formed by the assembly for one side of the wall. Assuming equidistance interspersal with the studs of the opposite side, the center line distance from stud to next adjacent stud would be 21 inches. This is slightly less than conventional stud spacing for present day dry wall commercial construction, although somewhat greater than the 16-inch spacing which has long been the standard stud spacing for wooden wall framing, and is required as well by some codes for metal framed dry-wall construction.

When the member is intended for ceiling use, i.e., in which unsupported spans of the order of 6 feet are contemplated, the width of the panel is reduced to provide appropriate spacing of the ceiling "joists" formed by each pair of justaposed construction member flanges. In this instance, a 2-foot wide gypsum board panel is contemplated as the base material with flanges having an outside depth of three inches to provide an overall width of 18 inches, which then also becomes the center-line distance between adjacent joists.

It will be recognized that each of the construction members of the invention is in effect the self-studded component of a wall, or the self-joisted component of a ceiling. The saving of erection time, labor, and cost in the use of a construction module of this kind will be appreciated from the further detailed description to follow.

DETAILED DESCRIPTION OF THE INVENTION

As already indicated in the general summary, and by FIGS. 2 and 3 of the drawings, the construction member 20 of the invention is basically a shallow, channel-shaped member which may be assembled vertically with others to form a wall, as in FIG. 2, or assembled horizontally with others to form a ceiling, as in FIG. 3.

The preferred fabrication of the construction member is indicated diagramtically by FIG. 1, with modification and further detail shown in FIGS. 4 to 6 inclusive. FIGS. 7 to 12 show erection details which will orient those skilled in the art and serve also to illustrate to them the time and cost savings to be had from use of the invention.

Referring to FIG. 1 in particular, the upper part of the drawing shows a flat board member 20 which could be a 4-foot wide or a 2-foot wide gypsum board sheet, having two V-shaped grooves 22, the sides of which are perpendicular to each other and the vertex of which is parallel to the long edge of the sheet. The grooves are spaced inwardly from the edges of the board a distance approximately equal to the desired depth of the flanges 24 to be formed by bending up the narrow side portions of the sheet along the vertices of the V-grooves, and define between them the panel portion 26 of the board. The V-shaped grooves may either be milled in a panel of otherwise conventional fabrication, or otherwise formed by cutting tools if not milled, or, in the case of gypsum board, may be formed as part of the board in its initial fabrication.

In either case, the V-grooves thus milled, cut or otherwise formed leave intact a sufficient thickness of the paper skin or other laminate on the side of the board 20 opposite the groove to serve as a hinge about which to form the construction member 28 by bending up the flanges 24 as indicated by the transition between the upper and lower portions of FIG. 1 of the drawings. An adhesive applied to the V-groove at or before the time of the bending up of the flanges, secures the flanges to the panel portion 26 of the construction member 28 in the perpendicular arrangement indicated in the lower portion of FIG. 1 and in subsequent drawings, the bond being sufficient to enable the flanges to materially stiffen, i.e., to enhance the longitudinal bending strength of, the member.

While the two-step fabrication of FIG. 1 is preferred in order to permit shipment of the member as a flat "blank" to be subsequently formed up at the erection site or at some intermediate station close to the job, I have contemplated, and have so indicated by FIG. 4, the possibility of casting integrally flanged gypsum board, instead of forming by the V-notch, fold-up procedure. I have not, however, actually fabricated any construction members by that procedure, and believe, as far as gypsum board is concerned, that shipment of the gypsum board sheet as a pre-grooved but unfolded or flat blank is preferable to facilitate the handling and to minimize the damage to be expected from shipment and trans-shipment in the channel-shaped form.

In FIG. 5, I show the gypsum board blank 20 grooved to the depth of the gypsum filler 30 between the customary paper lamina 32 and 34 on opposite sides thereof. In addition, and by way of example only, I have shown on the notched side of the sheet which becomes the interior in contemplated wall construction assembly an optional additional lamina 36, which may, for example, be a metal foil where a vapor barrier is desired, as in the exterior wall construction shown in cross section in FIG. 7. The paper skin 34 on the lower side of the sheet, which becomes the outside, or the "dress" side, when the flanges 24 are folded up, is left intact by the grooving, and may also have an optional layer 38 of a prefinishing material such as vinyl.

To fabricate the construction member 28 from the grooved blank of FIG. 5, a viscous liquid adhesive, such as STA-STUCK SS-2000A, manufactured by Specialty Chemicals Company of Elk Grove Village, ILL, is deposited in the V-grooves in sufficient quantity to provide a slight exuded fillet 40 when the flanges 24 are folded up, as indicated in the lower portion of Flg. 5, and a sufficient waiting period allowed, of the order of 15 minutes, for the adhesive to set up before further handling. If desired for greater strength when using sheet of lighter gauge, e.g., one-half inch, the mitered joint may be reinforced at intervals with glue blocks on the inside of the corner.

FIG. 6 illustrates a form of treatment of a gypsum board blank 20′ to provide V-grooves during the process of manufacture of the board. In this instance, the upper paper layer 32 of the board is formed into a V-shaped groove 22′ penetrating the gypsum filler 30′ while the gypsum is still in a fluid state, with suitable provision for the retention of the penetration until the gypsum filler has set up. The FIG. 6 arrangement contemplates the application of a contact adhesive 42 to both walls of the V-grooves 22′ and to the upper surface of the board 20′ along a narrow margin flanking the grooves, all covered by a releasable protective "peel" tape 44. The arrangement of FIG. 6 would greatly increase the handleability of the construction member and greatly facilitate the erection of the flanges 24′ into stable bracing arrangement with the panel portion 26 of the construction member on the job site.

The illustrative sample of Flg. 6 also shows an optional interior laminate 36′ of a vapor barrier such as foil, and the optional exterior laminate 38′ such as a decorative vinyl.

Comparing the two corner treatments of FIGS. 5 and 6, it will be noted that the paper-lined groove of the FIG. 6 modification produces a slightly larger outside radius at the corner of the construction member when the flange is bent into place. To compensate for the additional paper material packed into the joint particularly at or near the folding axis, the V-groove is preferably made slightly larger than 90° so that when the flange 24′ is folded up, and the two walls of the groove brought into contact, the flange 24′ will be perpendicular to the panel portion 26′ of the construction member.

UTILIZATION

The basic plan for the application of the construction member of the invention to wall construction, as already indicated, is shown in FIG. 2, i.e., with the construction members 28 standing vertically in butted, side-by-side relation on both sides of the wall, and with the studs formed by their flanges 24 interspersed so that the studs integral with one side of the wall are in touching bracing contact with the panel portions 26 of the construction members of the opposite side.

The adaptation of this basic assembly plan to exterior wall construction is illustrated in FIG. 7.

For exterior wall construction the sheet material of the outside members is preferably one of greater structural strength, such as wood. In FIG. 7, the construction members 46 which constitute the outside of the wall are shown as formed from plywood sheet 48, but for this application particle board is also suitable. In this instance, I show the exterior construction members as sheathed with an outer lamina 50 of metal which may be either steel or aluminum, and preferably prefinished. Adjacent exterior members 46 are abutted in line preferably with an application of caulking material at the joints, and then fastened together, as indicated, by hardened wood screws driven through the abutting flanges 52.

The construction members 28 for the inside of the exterior wall are of gypsum board and placed in abutting aligned relation with the studs formed by their adjacent flanges 24 interspersed between those of the outer panels. They are screwed top and bottom to plate members, not shown, in the manner later to be described in connection with interior wall construction.

Gypsum board used in this manner, i.e., as the inner face of an exterior wall, will preferably have an inner layer 36 of a vapor barrier material, and the void between the interior and exterior construction members filled with insulation 54. For its utility as a bonding material as well as in providing highly efficient thermal insulation, I contemplate the ultimate use of a Freon-blow low-density, foamed, rigid polyurethane, with suitable provision in the top plates of the wall for the pouring of the material from portable equipment in the field, and with fixtures as necessary to prevent the "oil canning" of the panels as the polyurethane expands and sets up.

The detailing of the utilization of the construction members of the invention for interior wall construction, and as ceilings, is illustrated in FIGS. 8 to 12 inclusive.

As in typical dry-wall construction in commercial buildings, an interior wall (FIG. 8) is positioned by locating a channel-shaped floor track 60 along the intended axis of the wall. Such channels are usually roll-formed sheet steel in light gauge, easily penetrated by self-drilling, self-tapping screws, and are secured in place, openside up, by powder-driven nails 62, such as Ramset, or by tempered concrete nails, driven through the web of the channel or "floor track" into the floor 64.

Figure 8:
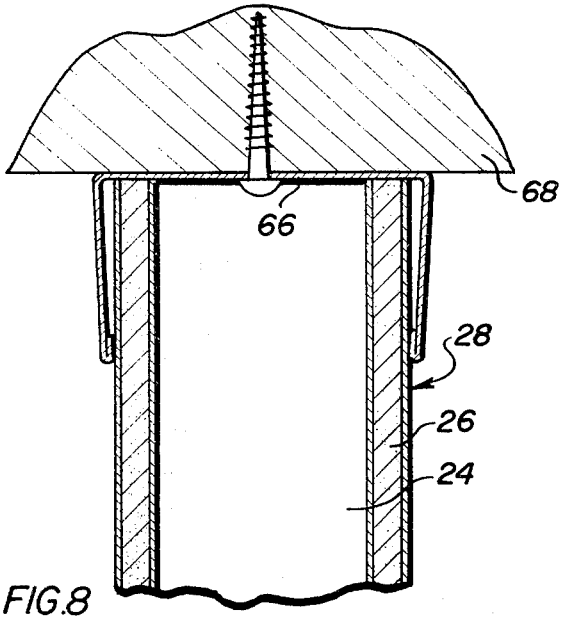
FIg. 8 is a vertical cross section of an interior partition wall fabricated of the construction members of the invention, assembled as in FIG. 2, and illustrating the demountable connection of such a wall to the floor and ceiling.

A hemmed ceiling track 66 of similar but wider channel shape and having smooth, hemmed, rounded edges on its flanges, is plumbed with the floor track 60 and secured by screws to the ceiling 68, with the track open downwardly. The flanges 24 of the gypsum-board construction members 28 are cut off at their lower ends 70 sufficiently to clear the floor track and to permit use of the track as raceway for electricl conduit. One side of the wall is then assembled by inserting the construction members 28 into the ceiling track, and abuttng them to the floor track, to which they are secured with screws 72 driven through the panel portion 26 of the construction member along its bottom edge, as indicated in FIG. 8.

With one side of the wall, or a substantial portion thereof, assembled, the opposite side is then applied, and secured in place in the same manner. The flanges of the ceiling track 66 provide the upper trim of the wall, and the power-driven screws 72 by means of which the construction members are secured to the floor track are concealed by the application of a base molding 74, usually molded vinyl, after the erection of the wall.

Figure 9:
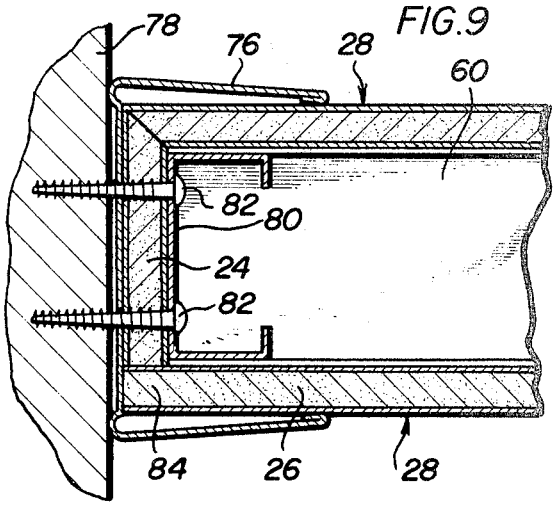
FIG. 9 is a fragmentary horizontal cross section of a wall assembled as in FIG. 2, illustrating the start of such a wall where it corners with a pre-existing wall.

The starting of a wall, where it adjoins another wall with an inside corner on both sides, is illustrated in FIG. 9.

In such case, and in addition to the laying of floor and ceiling track as described in connection with FIG. 8, a hemmed track 76 is secured vertically to the existing wall 78 on the desired axis of the new partition wall and lightly secured in place in any convenient manner, as for example by a pair of spaced self-tapping screws. A flanged gypsum board construction member 28 is then set into place within the hemmed wall track 76 and a sheet metal stud 80 is placed against the inside surface of the flange 24 of the gypsum board construction member 28, and screwed to the existing wall 78 at several levels by pairs of power driven screws 82 as indicated in FIg. 9, leaving sufficient space, however, for the subsequent insertion of the cut edge 84 of the panel portion 26 of the construction member 28 on the opposite side of the wall.

Figure 10:
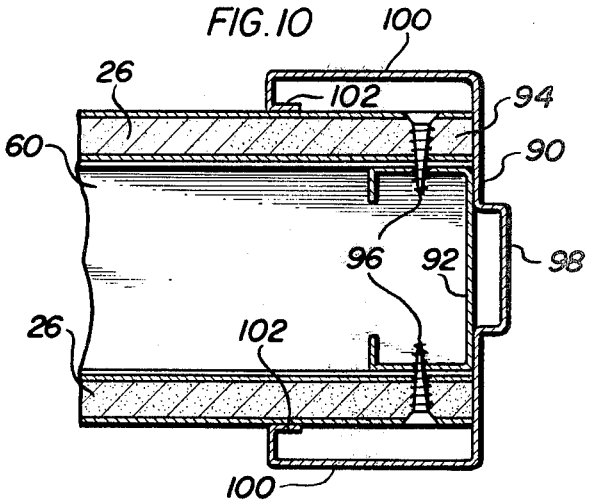
FIG. 10 is a similar fragmentary horizontal sectional view illustrating the framing of an interior doorway located randomly with respect to the joints between abutted construction members of the invention when assembled as a wall.

FIG. 10, as earlier indicated, is a fragmentary horizontal section which illustrates doorway framing occurring randomly with respect to the joints between adjacent construction members. The doorway is cut at the desired location which will have been predetermined by a gap in the floor track 60 of width to accommodate the door jamb 90. A sheet metal stud 92 is then inserted between the panel portions 26 of the gypsum board on opposite sides of the wall, and the cut ends 94 thereof are secured to the stud by screws 96. The sheet-metal door jamb 90 may be of wall-gripping press-on type, with integral doorstop 98, outer trim 100, and return anchor portions 102.

Figure 11:
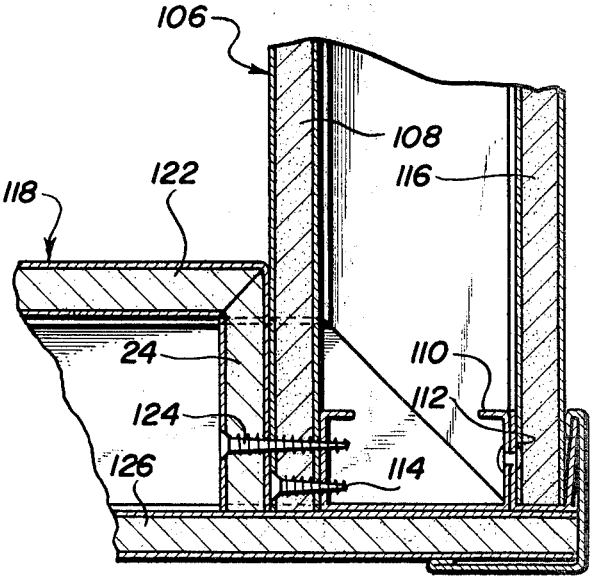
FIG. 11 is a similar fragmentary horizontal sectional view illustrating an exposed corner between walls fabricated as indicated in FIG. 2.

The detailing of an exposed corner of an interior partitioning is illustrated in FIG. 11, which is also a fragmentary horizontal section. In this instance, it is assumed that the section of wall 106 extending vertically in FIG. 11 was completed first. The construction member 108 on the inside of the corner is secured to a sheet-metal stud 110 having a corner molding 112 riveted to one of its flanges, by means of screws driven 114 through the panel of the interior construction member 108 and into the stud. The end panel 116 of the outside of the existing wall has its cut edge seated in the channel of the corner molding 112, which is secured to the stud.

The cornering wall 118 is then started by abutting the flange 24 of the construction member 122 on the inside of the new wall against the construction member 108 on the inside of the existing wall, with their edges flush, and securing the beginning construction panel 122 of the new wall to the end stud of the existing wall by means of self-tapping screws 124, driven through the double thickness of the gypsum board and into the flange of the stud 110. The outside side of the cornering wall is then started by the insertion of the cut edge of the cornering outer construction member 126 into the space between the corner molding 112 and the end of the existing wall 106.

Figure 12:
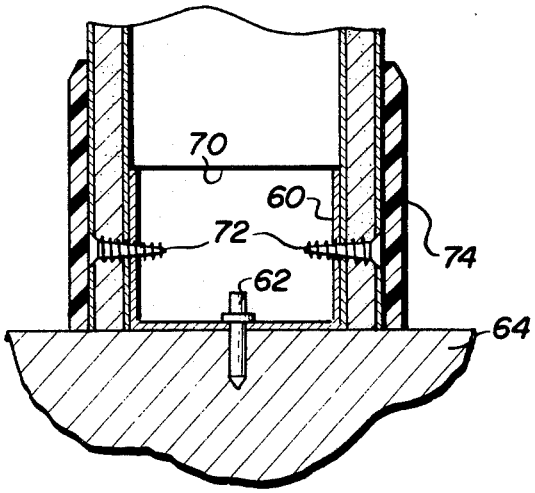
FIG. 12 is a fragmentary sectional elevation of a wall-ceiling joint illustrating the support of the construction member of the invention when employed as a ceiling member.
Figure 12:
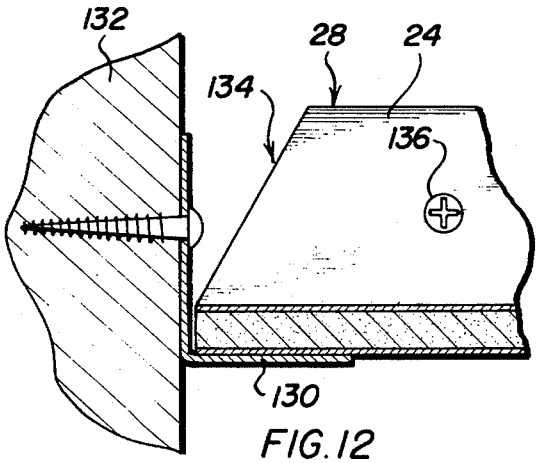

Ceiling installation is indicated by FIG. 12, a particularly suitable application being relatively long and narrow ceilings such as in corridors and the like. In such applications, the long dimension of the construction member 28 is placed transversly of the passageway, with the construction member unsupported between its ends, which rest upon sheet metal angles 130 secured to the adjacent wall 132 by means of screws. Hallway ceilings are quite typically lower than those of the adjacent spaces for the accommodation of duct work for utilities supplied to the privately occupied adjacent spaces, and the construction member 28 of the invention is especially suited to use in so-called "dropped" ceilings, of which corridors and passageways are a typical occurrence.

In such cases, as indicated in FIG. 12, the ends 134 of the upstanding flanges 24 of the individual construction members are relieved at an angle to permit the insertion of the member diagonally into the space above its intended level, the resting of one of its ends upon the supporting angle or other support while still positioned diagonally, and then the rotation of the opposite end of the panel down onto its support.

In ceiling application, the construction members are preferably connected together for mutual support, this being accomplished by the driving of screws 136 through abutted upstanding flanges of adjacent members, with the omission of such screws at intervals where desired for access to the overlying space. For spaces larger than corridors, the same arrangement is equally feasible but in such case the intermediate support consists of suspended track which is typically rail-shaped, i.e., with horizontal flanges on opposite sides of the track and with aperatures at intervals in the web of the track for the suspension of the same by means of stiff wire from a preexisting ceiling, or other overhead structure.

CONCLUSION

The saving of erection time, labor and cost which I have experienced utilizing the construction member of the invention as described in detail in the foregoing specification has been substantial resulting not only from the substantial elimination of studding and framing time, but also the elimination of the need to secure the gypsum board to studs.

Moreover the decorating of walls and ceilings made in the manner described is much simplified from existing conventional dry-wall practice, particularly by the elimination of the necessity for taping and spackling seams between adjacent wall board panels. These savings may further be enhanced by precladding the dress side of the construction member with an eye-pleasing finishing surface such as vinyl, but even in the simplest, paper-surface form, the walls after erection are ready for painting without requiring the time-consuming and costly patching which has been a necessary incident of existing dry-wall construction practice.

The features of the invention believed new and patentable are set forth in the appended claims.

I claim:

1. A building construction member which may be shipped to the jobsite in flat condition and formed at the jobsite into a wide, shallow, channel-shaped member with a central panel portion and having flanges extending equally and perpendicularly in the same direction from one face of the panel at opposite long edges thereof, comprising a rectangular panel of gypsum board having face laminae and a core layer of gypsum therebetween, said board having on one face thereof two V-grooves consisting of one V-groove set inwardly from each long edge for the full length of the gypsum board which penetrate the gypsum core substantially for the entire depth of said core leaving intact a sufficient thickness of the lamina of the face opposite the grooved face to act as a hinge, said grooves having adhesive means therein and defining between them a central panel portion with flanking flanges outwardly of said grooves when said flanges are hinged perpendicularly to said central panel portion and retained in that position by the adhesive means in said grooves.

2. The construction member of claim 1 having a continuous, unbroken outer lamina spanning said panel from flange to opposite flange on the face thereof opposite said one face, and extending at least around the outsides of the corners formed by the juncture of said panel and flanges.

3. The construction member of claim 2 wherein said panel with integral flanges is formed by a bonded miter joint.

4. The construction member of claim 2 in which the unbroken lamina is the paper skin of the gypsum board.

5. The construction member of claim 4 having additional prefinished lamina on at least one side.

6. The construction member of claim 3 in which the unbroken lamina is the paper skin of the gypsum board.

7. The building construction member of claim 1 in which the grooves are lined with a lamina secured to the gypsum area.

8. The building construction member of claim 7 in which the lamina lining the groove is an integral part of the lamina covering the grooved face of the board.

9. The building construction member of claim 7 in which the lamina lining the grooves is coated with a contact adhesive covered further by a peelable protective strip.

10. An interior building wall having two faces, each of said faces comprising multiple juxtaposed construction members as defined by claim 1 in planar array with flanges of adjacent members vertically abutting each other, the abutted flanges of those members comprising one face of the wall being medially interspersed in touching bracing contact with the opposite panel and forming studs between the studs so formed by the adjacent flanges of the members of the opposite face.

11. An exterior building wall having two faces, the inner of said faces comprising multiple juxtaposed construction members as defined by claim 1 in planar array with flanges of adjacent members vertically abutting each other, the outer of said faces comprising a rectangular panel of wood having integral flanges extending equally and perpendicularly in the same direction from one face of the panel at opposite long edges thereof, the abutted flanges of the members of one face of the wall being medially interspersed in touching bracing contact with the opposite panel and forming studs between the studs so formed by the adjacent flanges of the members of the opposite face.

12. The exterior building wall of claim 11 having additional prefinished lamina on the exterior of the outer face.

13. The exterior building wall of claim 12 wherein said additional prefinished lamina is selected from the group consisting of steel and aluminum.

14. The exterior building wall of claim 13 having insulation between said faces.

15. The wall of claim 10 in which said interposed studs formed by the members of one face of the wall engage the panel portion of the members of the opposite face.

16. An interior partition wall in accordance with claim 10 wherein the assembly is maintained by connection of said members top and bottom to ceiling and floor.

* * * * *